United States Patent [19]

Skinner

[11] 4,365,939

[45] Dec. 28, 1982

[54] FUEL INJECTION PUMPING APPARATUS

[75] Inventor: Robert T. J. Skinner, High Wycombe, England

[73] Assignee: Lucas Industries Limited, Birmingham, England

[21] Appl. No.: 158,629

[22] Filed: Jun. 11, 1980

[30] Foreign Application Priority Data

Jul. 6, 1979 [GB] United Kingdom ..... 7923684

[51] Int. Cl.[3] ..... F04B 49/00; F04B 19/00; F04B 29/00

[52] U.S. Cl. ..... 417/221; 123/502

[58] Field of Search ..... 417/462, 218, 221; 123/502

[56] References Cited

U.S. PATENT DOCUMENTS

| | | | |
|---|---|---|---|
| 3,051,154 | 8/1962 | Kemp | 123/502 |
| 3,552,366 | 1/1971 | Kemp | 417/218 X |
| 3,828,400 | 8/1974 | Mason et al. | 91/497 |
| 4,037,573 | 7/1977 | Swift | 417/221 X |
| 4,195,553 | 4/1980 | Klie | 417/221 X |

FOREIGN PATENT DOCUMENTS

| | | | |
|---|---|---|---|
| 516434 | 9/1955 | Canada | 417/462 |
| 55-153827 | 12/1980 | Japan | 123/502 |

*Primary Examiner*—William L. Freeh

[57] ABSTRACT

A fuel injection pumping apparatus includes a piston located within a cylinder. The piston is connected to an annular cam ring of a rotary distributor type fuel pump to adjust the timing of delivery of fuel. A passage conveys fluid under pressure to act on the piston to move the piston against the actions of a spring. The passage includes a check valve to prevent movement of the piston and cam ring when a pump plunger is moved inwardly by a cam lobe on the cam ring and a further check valve which prevents movement of the piston and cam ring when the plunger is allowed to move outwardly by the cam lobe.

7 Claims, 2 Drawing Figures

FUEL INJECTION PUMPING APPARATUS

This invention relates to fuel injection pumping apparatus of the kind comprising a body part in which is mounted an injection pump including an angularly adjustable cam, and a plunger which is mounted in a rotary part and which is adapted to be moved inwardly by the action of the cam as the part rotates, passage means for conveying fuel to and from a bore containing the plunger, a piston contained within a cylinder, means connecting the piston to said cam so that axial movement of the piston within the cylinder will impart angular movement to the cam, means biassing the piston towards one end of the cylinder to retard the timing of delivery of fuel from the bore, passage means for supplying liquid under pressure to said one end of the cylinder and a one way valve positioned in said passage means, said valve acting to prevent the sudden flow of liquid through said passage means from said one end of the cylinder as the cam imparts inward movement to the plunger.

The action of said valve is to maintain the cam in a substantially fixed position whilst the plunger is moved inwardly by the cam. This is itself advantageous but the valve has the added duty of preventing pressure pulsations in the cylinder passing by way of the passage means to other parts of the hydraulic system of the apparatus. It has been found that there can be an opposite reaction imparted to the cam when the relative position of the cam and plunger is such that the plunger can move outwardly. The aforesaid valve cannot in this situation prevent movement of the piston with the result that the position of the cam may alter and upset the subsequent timing of delivery.

The object of the invention is to provide an apparatus of the kind specified in a simple and convenient form.

According to the invention an apparatus of the kind specified includes valve means through which liquid can flow into and out of the other end of the cylinder, said further valve acting to prevent a sudden flow of liquid out of the other end of the cylinder.

One example of a fuel injection pumping apparatus in accordance with the invention will now be described with reference to the accompanying drawings in which.

Figure 1:
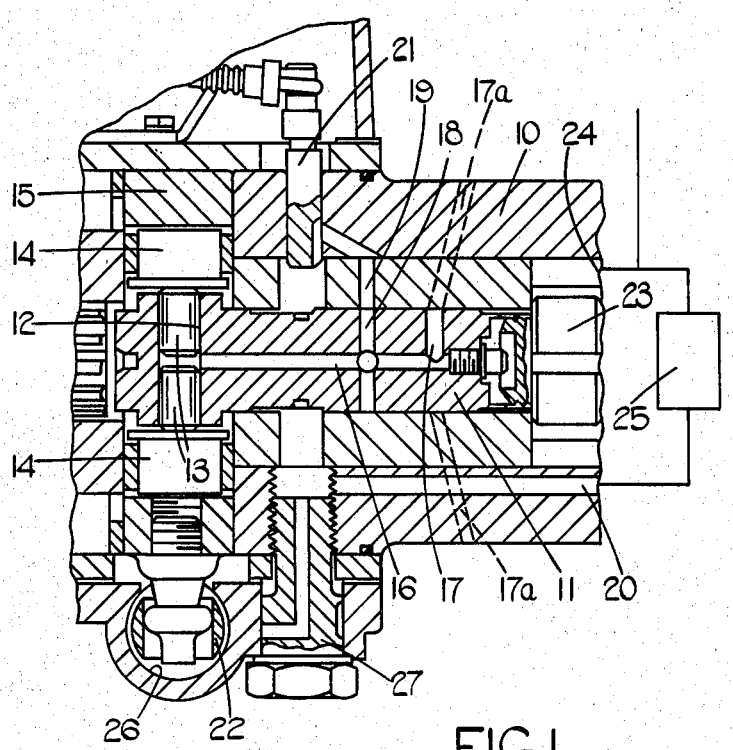
FIG. 1 is a sectional side elevation of part of the apparatus.

Referring to FIG. 1 of the drawings the apparatus comprises a body part 10 in which is mounted a rotary cylindrical distributor member 11. The distributor member is connected to a shaft whereby it can be driven in timed relationship with an associated engine. Formed in the distributor member is a transversely extending bore 12 in which is mounted a pair of plungers 13. The plungers at their outer ends engage cam followers 14 including rollers which engage with the internal peripheral surface of an angularly adjustable cam ring 15.

The bore 12 communicates with a longitudinal passage 16 formed in the distributor member and which communicates with a radially extending delivery passage 17. The passage 17 can communicate in turn as the distributor member rotates, with a plurality of outlets **17*a* formed in the body part 10** and which in use, are connected to the injection nozzles respectively of the associated engine.

The passage 16 also communicates with a plurality of radially disposed inlet passages 18 which are adapted to register with an inlet port 19 the latter being formed in the body part. Also located in the body part is an angularly adjustable throttle member 21 through which fuel flowing through a passage 20, can flow to the inlet port 19. The passage 20 communicates with the outlet of a feed pump 23 having an inlet 24. The rotary part of the feed pump is driven from the distributor member 11 and the inlet and outlet of the pump are interconnected by a relief valve 25 which acts to control the output pressure of the feed pump so that it varies in accordance with the speed at which the apparatus is driven.

The operation of the device as described is as follows and starting from the position shown in FIG. 1. In the position shown fuel is being supplied to the bore 12 by way of the passage 20, the throttle member 21 and the inlet port 19 which is in register with one of the inlet passages 18. As the distributor member rotates the communication of the inlet port with the one inlet passage is broken and the passage 17 is brought into register with one of the outlets **17*a*. Inward movement is now imparted to the plungers by way of the cam followers 14 due to the action of cam lobes formed on the internal peripheral surface of the cam ring. The plungers are moved inwardly and fuel is displaced through an outlet 17*a*** to the associated fuel injection nozzle. The cycle is repeated as the distributor member is further rotated.

The cam ring 15 is angularly adjustable and for this purpose a piston 22 is connected to the cam ring by means of a radially disposed peg. The piston 22 is shown in FIG. 2 and is located within a cylinder 26 formed in a part which is secured to the body part 10 of the apparatus by means of a bolt 27 which conveniently provides a fuel connection from the passage 20.

Figure 2:
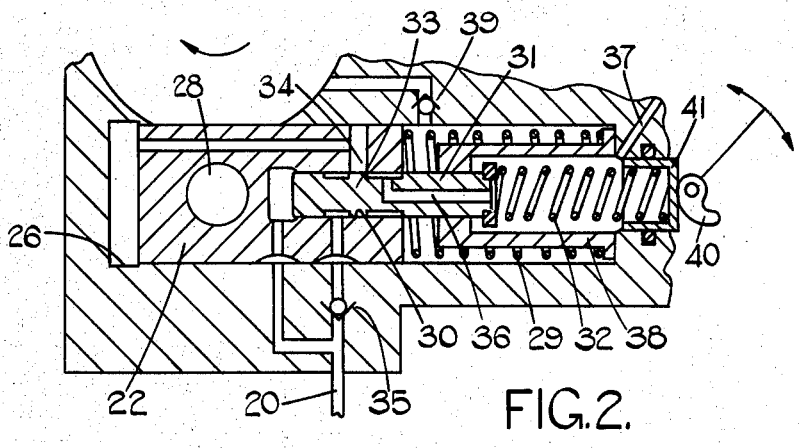
FIG. 2 is a section at right angles through part of the apparatus seen in FIG. 1.

As shown in FIG. 2 the piston is provided with an aperture 28 to receive the radial peg and it also is biassed towards the left as seen in FIG. 2 by means of a coiled compression spring 29. Formed in the piston is a blind bore 30 having its open end opening into the end of the cylinder 26 containing the spring 29. The bore 30 accommodates a spool element 31 which is spring loaded by means of a coiled compression spring 32 towards the blind end of the bore in which the spool is located. The blind end of the bore 30 is connected by way of passages formed in the piston 22 and the wall of the cylinder 26 with the passage 20 so that as the output pressure of the feed pump 25 vaies so will the position of the spool valve. The pressure applied to the spool may however be derived from some other source.

The valve is provided with a pair of axially spaced grooves and these are separated by a land 33 which can cover a port 34 formed in the wall of the bore 30 and communicating with the end of the cylinder 26 remote from the spring 29. This communication is by way of a passage formed in the piston 22. The land 33 is of a width such that it can just cover the port 34.

A further port is formed in the wall of the bore 30 and which is in constant communication with the circumferential groove formed in the spool valve and which is on the side of the land 33 remote from the spring 32. This port communicates with the passage 20 by way of a non return check valve 35. The valve 35 is positioned to permit the flow of fuel from the passage 20 into the circumferential groove but to prevent flow in the reverse direction.

The width of the other groove which is formed in the spool 31 is such that when the land 33 is covering the port 34, the groove itself is covered by the piston. The groove communicates by way of a passage 36 with a space which contains the spring 32 and which is in constant communication with a drain indicated at 37, and conveniently connected to the inlet of the pump 25. The space containing the spring 32 is hydraulically isolated from the portion of the cylinder 26 containing the spring 29 by means of a member 38 of top hat section. The spool 31 has a working clearance with the wall of an aperture in the end wall of the member 38 so that there is substantially no leakage of fuel along the working clearance. The portion of the end of the cylinder 26 which contains the spring 29 is vented to a drain by way of a further non return valve 39 this being positioned to prevent sudden flow of fuel out of the cylinder.

In operation the various parts are shown in what is termed an equilibrium position. If however the output pressure of the feed pump increases then an increase in pressure will be applied to the spool 31 and this will move against the action of the spring 32. Such movement exposes the port 34 to the groove to the left of the land 33 and since this communicates with the passage 20, fuel will flow through the port 34 into the end of the cylinder remote from the spring 29. This flow of fuel will effect displacement of the piston towards the right and a new equilibrium position will be attained with the port 34 covered by the land 33 and the right hand groove covered by the wall of the bore 30. As the piston 22 moves towards the right fuel will be displaced from the right hand end of the cylinder but this fuel can flow by way of the circumferential groove which is to the right of the land 33 and the passage 36 to the drain 37. If the output pressure of the feed pump should fall then the spool will move towards the left and the right hand groove will be exposed to the port 34. This will permit fuel to flow through the port 34 from the cylinder and the piston will move under the action of the spring 29. Such movement of the piston will cause fuel to be drawn into the cylinder by way of the valve 39.

During operation of the apparatus when the rollers of the cam followers engage the cam lobes, there will be a force applied to the piston 22 which will tend to move it towards the left as seen in FIG. 2. This movement will tend to uncover the port 34 to the left hand circumferential groove of the spool. Fuel is however prevented from flowing by the action of the valve 35 hence the piston will be hydraulically locked within the cylinder 26. When the rollers move over the crest of the cam lobes the reaction on the piston 22 will be in the opposite direction. However, in this situation the valve 39 closes to prevent sudden escape of fluid from the portion of the cylinder 26 which contains the spring 29 and similarly the piston will be hydraulically locked. If the valve 39 were not present then the piston could move by an amount sufficient to expose the port 34 to the right hand circumferential groove. This would permit fuel to be drawn into the cylinder 26 by the movement of the piston and the latter might not regain its correct position in time for the next delivery of fuel.

FIG. 2 shows in addition how the force exerted by the spring 32 on the spool can be varied by means of an adjustable member 40 which co-acts with an abutment 41 for the spring 32. The member 40 can be connected to the throttle 21 so that the timing of delivery of fuel will also vary in accordance with the amount of fuel which is being supplied by the apparatus to the associated engine.

I claim:

1. A fuel injection pumping apparatus comprising a body part in which is mounted an injection pump including an angularly adjustable cam having cam lobes, and a plunger which is mounted in a rotary part and which is adapted to be moved inwardly by the action of the cam lobes as the part rotates, passage means for conveying fuel to and from a bore containing the plunger, a piston contained within a cylinder, means connecting the piston to said cam so that axial movement of the piston within the cylinder will impart angular movement to the cam, means biassing the piston towards one end of the cylinder to retard the timing of delivery of fuel from the bore, passage means for supplying liquid under pressure to said one end of the cylinder, a valve member which controls the flow of liquid both into and out of said one end of the cylinder and the flow of liquid from the other end of said cylinder, a first one way valve positioned in said last named passage means, said first one way valve acting to prevent the sudden flow of liquid through said passage means from said one end of the cylinder as the cam lobes impart inward movement to the plunger as well as movement to said piston, and a second one way valve through which liquid can flow into the other end of the cylinder, said second one way valve acting to prevent a sudden flow of liquid out of the other end of the cylinder as the cam lobes allow outward movement of the plunger as well as movement of the piston.

2. An apparatus according to claim 1, wherein said valve member is located within a blind bore in the piston, and there is resilient means located in said cylinder and acting upon the valve member, a passage for conveying liquid under pressure to the blind end of said bore, said liquid under pressure acting upon said valve member to move same against the action of the resilient means, and means located within said cylinder to isolate the outer end of said valve member from the pressure within the other end of the cylinder.

3. An apparatus according to claim 2, in which said last named means comprises a top-hat section member located about the outer end of said valve member, the base wall of said member having an aperture formed therein through which the valve member extends, said valve member and said aperture defining a working clearance to substantially prevent the flow of liquid into the space defined in said member from the other end of the cylinder, and in which said space communicates with a drain.

4. An apparatus according to claim 3, in which said valve member comprises a spool having a central land and a pair of grooves on opposite sides thereof, and there is a port in the wall of said bore adapted to be covered by said land in an equilibrium position of the valve member and piston, said port communicating with said one end of the cylinder, a passage through which the one groove on the side of the land near to the blind end of the bore communicates with a source of liquid under pressure, said port and said passage constituting said last named passage means, and a further passage through which the other groove communicates with a drain, said other groove in the equilibrium position being covered by the wall of the bore in the piston, but being exposed to the other end of the cylinder when said valve member is moved against the action of the resilient means and until a new equilibrium position is established.

5. An apparatus according to claim 3, in which said resilient means comprises a coiled compression spring located within said space.

6. An apparatus according to claim 5, including means operable to vary the force exerted on the valve member by said spring.

7. An apparatus according to claim 4, in which said further passage is formed in the spool and communicates with said space.

* * * * *